US005939364A

United States Patent [19]

Polizzotti et al.

[11] Patent Number: 5,939,364

[45] Date of Patent: Aug. 17, 1999

[54] LUBRICATING OIL CONTAINING ADDITIVE COMPRISING REACTION PRODUCT OF MOLYBDENUM DITHIOCARBAMATE AND DIHYDROCARBYL DITHIOPHOSPHORIC ACID

[75] Inventors: Richard Samuel Polizzotti, Milford; Elisavet P. Vrahopoulou, Chatham; Stephen D. Cameron, Milford; Charles Frederick Pictroski, Glen Gardner, all of N.J.

[73] Assignee: Exxon Research & Engineering Co., Florham, N.J.

[21] Appl. No.: 08/990,054

[22] Filed: Dec. 12, 1997

[51] Int. Cl.[6] ..... C10M 135/18; C10M 137/10

[52] U.S. Cl. ..... 508/363; 508/364; 508/379; 556/25; 556/26

[58] Field of Search ..... 508/363, 364, 508/379; 556/25, 26

[56] References Cited

U.S. PATENT DOCUMENTS

| | | | |
|---|---|---|---|
| 2,354,536 | 7/1944 | Nelson | 508/363 |
| 2,951,040 | 8/1960 | Hugel et al. | 252/33.6 |
| 3,356,702 | 12/1967 | Farmer et al. | 508/363 |
| 3,419,589 | 12/1968 | Larson et al. | 260/429 |
| 3,509,051 | 4/1970 | Farmer et al. | 508/363 |
| 3,840,463 | 10/1974 | Froeschmann et al. | 252/42.7 |
| 4,098,705 | 7/1978 | Sakuri et al. | 508/363 |
| 4,178,258 | 12/1979 | Papay et al. | 508/363 |
| 4,289,635 | 9/1981 | Schroeck | 252/332.7 E |
| 4,395,434 | 7/1983 | Imada et al. | 427/38 |
| 4,456,538 | 6/1984 | Ripple | 252/32.7 E |
| 4,529,526 | 7/1985 | Inoue et al. | 508/364 |
| 4,559,152 | 12/1985 | Schlicht | 252/32.7 E |
| 4,705,641 | 11/1987 | Goldblatt et al. | 252/35 |
| 4,730,064 | 3/1988 | Halbert et al. | 556/15 |
| 4,786,423 | 11/1988 | Schroedar | 508/363 |
| 4,812,246 | 3/1989 | Yabe | 508/364 |
| 4,846,983 | 7/1989 | Ward, Jr. | 252/33.6 |
| 4,915,857 | 4/1990 | Emert et al. | 252/32.7 E |
| 4,919,830 | 4/1990 | Farng et al. . | |
| 4,966,719 | 10/1990 | Coyle et al. | 252/42.7 |
| 4,978,464 | 12/1990 | Coyle et al. | 252/42.7 |
| 4,995,996 | 2/1991 | Coyle et al. | 252/42.7 |
| 5,002,674 | 3/1991 | Farng et al. . | |
| 5,013,467 | 5/1991 | Emert et al. | 252/46.4 |
| 5,049,290 | 9/1991 | Emert et al. | 252/32.7 E |
| 5,627,146 | 5/1997 | Tanaka et al. | 508/363 |
| 5,631,212 | 5/1997 | Vrahopoulou | 508/192 |
| 5,641,731 | 6/1997 | Baumgart et al. | 508/183 |
| 5,763,370 | 6/1998 | Doner et al. | 508/364 |
| 5,814,587 | 9/1998 | Vrahopoulou et al. | 508/363 |

FOREIGN PATENT DOCUMENTS

| | | | |
|---|---|---|---|
| WO95/07963 | 3/1995 | WIPO | C10M 141/08 |
| WO95/19411 | 7/1995 | WIPO | C10M 135/18 |

OTHER PUBLICATIONS

Mitchell et al, "Molybdenum Phosphorodithioato Complexes . . . ", in Berry & Mitchell, eds., Proceeding of the 4th Climax Int'l Conf. on Chem and Uses of Molybdenum, Ann Arbor, MI, pp. 212–217 (1982). month Unknown.

Meienberger et al, "The reactivity of complexes containing . . . ", 213 Inorganica Chimica Acta., pp. 157–169 (1993). Month Unknown.

Jain et al, "The role of metallic stearate additions in solid lubricants", Wear, 148 (1991), 1–13. Month Unknown.

Shibahara, "Synthesis of sulphur–bridged molybdenum and tungsten coordination compounds", Coordination Chemistry Reviews, 123 (1993), pp. 73–147. Month Unknown.

*Primary Examiner*—Margaret Medley

*Attorney, Agent, or Firm*—Ohlandt, Greeley, Ruggiero & Perle

[57] ABSTRACT

Multifunctional molybdenum compounds, which are the reactive product of molybdenum dithiocarbamates and (non-metal containing) dihydrocarbyl dithiophosphoric acids, and the oils that contain them are new compositions which are useful as lubricant additives. They impart to the lubricant formulations to which they are added low friction and excellent friction retention properties.

6 Claims, 1 Drawing Sheet

LUBRICATING OIL CONTAINING ADDITIVE COMPRISING REACTION PRODUCT OF MOLYBDENUM DITHIOCARBAMATE AND DIHYDROCARBYL DITHIOPHOSPHORIC ACID

FIELD OF THE INVENTION

This invention relates to lubricating oils containing additives that impart low friction and friction retention characteristics during oil use.

BACKGROUND OF THE INVENTION

The reduction in friction performance in lubricants has been pursued in the industry for a number of years. Because of environmental concerns, industry more recently is focusing on enhancing the fuel economy benefits over extended periods of oil use.

U.S. Pat. No. 4,178,258 teaches a lubricating oil for use in spark ignition and compression ignition engines which exhibits enhanced antiwear and friction characteristics by containing an antiwear amount of a molybdenum bis(dialkyl dithiocarbamate). The lubricant is described as being especially effective in reducing wear and friction if the lubricant also contains a zinc dialkyldithiophosphate (ZDDP).

U.S. Pat. No. 4,395,434 teaches an antioxidant additive combination for lube oils prepared by combining a sulfur containing molybdenum compound prepared by reacting an acidic molybdenum compound, a basic nitrogen compound and carbon disulfide with an organic sulfur compound. The organic sulfur compound is described as including metal dialkyldithiophosphates, and metal dithiocarbamates, among other organic sulfur compounds.

U.S. Pat. No. 4,529,526 teaches a lubricating oil composition comprising a base oil and a sulfurized oxymetal organic phosphorodithioate and/or a sulfurized oxymetal-dithiocarbamate and at least one zinc alkylcarbyl dithiophosphate, along with a calcium alkybenzene or calcium petroleum sulfonate and an alkenylsuccinic acid imide.

U.S. Pat. No. 4,786,423 teaches an improved lubricant which contains a mineral or synthetic base stock oil and two heavy metal compounds as well as a metal and sulfur free phosphorous compound. The heavy metal compounds can be molybdenum dithiocarbamate in combination with zinc dialkyldithiophosphate. The other phosphorous compound can be trialkyl or triaryl phosphate. The lubricant is prepared by, for example, heating the base stock to between room temperature and about 100° C. for two hours, then adding the subsequent components to the heated oil approximately 20 minutes apart under the referenced elevated temperature.

WO 95/19411 (PCT/US95/00424) is directed to additives for lubricants which are combinations and reaction products of metallic dithiocarbamates and metallic dithiophosphates. The preblended combinations and reaction products are described as showing good stability and compatibility when used in the presence of other commonly used additives in grease or lubricant compositions. The metals of the metal dithiophosphates and metal dithiocarbamates may be selected from nickel, antimony, molybdenum, copper, cobalt, iron, cadmium, zinc, manganese, sodium, magnesium, calcium and lead. The combination and reaction products are described as providing enhanced friction reducing and anti-wear properties at extreme pressure. Additional anti-oxidation, cleanliness, anti-fatigue, high temperature stabilizing and anti-corrosion properties are also described as potentially present. The metallic dithiocarbamate and metallic dithiophosphate are mixed, generally at any suitable conditions with temperatures varying from −20° C. to 250° C., preferably between 50° C. and 150° C. Reaction rather than blending will usually occur if the temperature is between 70° C. and 100° C. The metallic dithiocarbamates and the metallic dithiophosphates may be combined in any ratio from 1:9 to 9:1. In the Examples, reaction temperatures of only 80° C. to 100° C. were employed.

U.S. Pat. No. 4,812,246 teaches a lubricating composition comprising a particular base oil and additives comprising a phenol based antioxidant and/or organomolybdenum compounds such as molybdenum dithiocarbamate. The lubricating composition can also contain other common additives such as zinc dialkyl dithiophosphates, etc.

M. Meienberger, et al., Inorganica Chimica Acta 213, p. 157–169 (1993) discloses the reactions of certain $(Mo_3S_7L_3)^{+4}$ compounds.

Copending U.S. application Ser. No. 766,828, filed Dec. 13, 1996 discloses a method for making a lube oil composition using a different reaction product, i.e., the reaction product of molybdenum dialkyl dithiocarbamate and metal dihydrocarbyl dithiophosphate. Disadvantageously this reaction forms a metal precipitate which must be separated from the product before use.

Due to environmental concerns and Corporate Average Fuel Economy ("CAFE") requirements, the industry is placing increasing emphasis not only on the initial fuel economy performance of engine oils, but also on the retention of the performance during oil use. Certain molybdenum friction modifiers are known to offer frictional benefits, which, however, degrade as the oil ages (K. Arai et. al., "Lubricant Technology To Enhance The Durability Of Low Friction Performance Of Gasoline Engine Oils", SAE 952533 (1995)). It would be desirable to have an engine oil with improved friction performance and friction retention properties. Applicants' invention addresses these needs.

SUMMARY OF THE INVENTION

Figure 1:
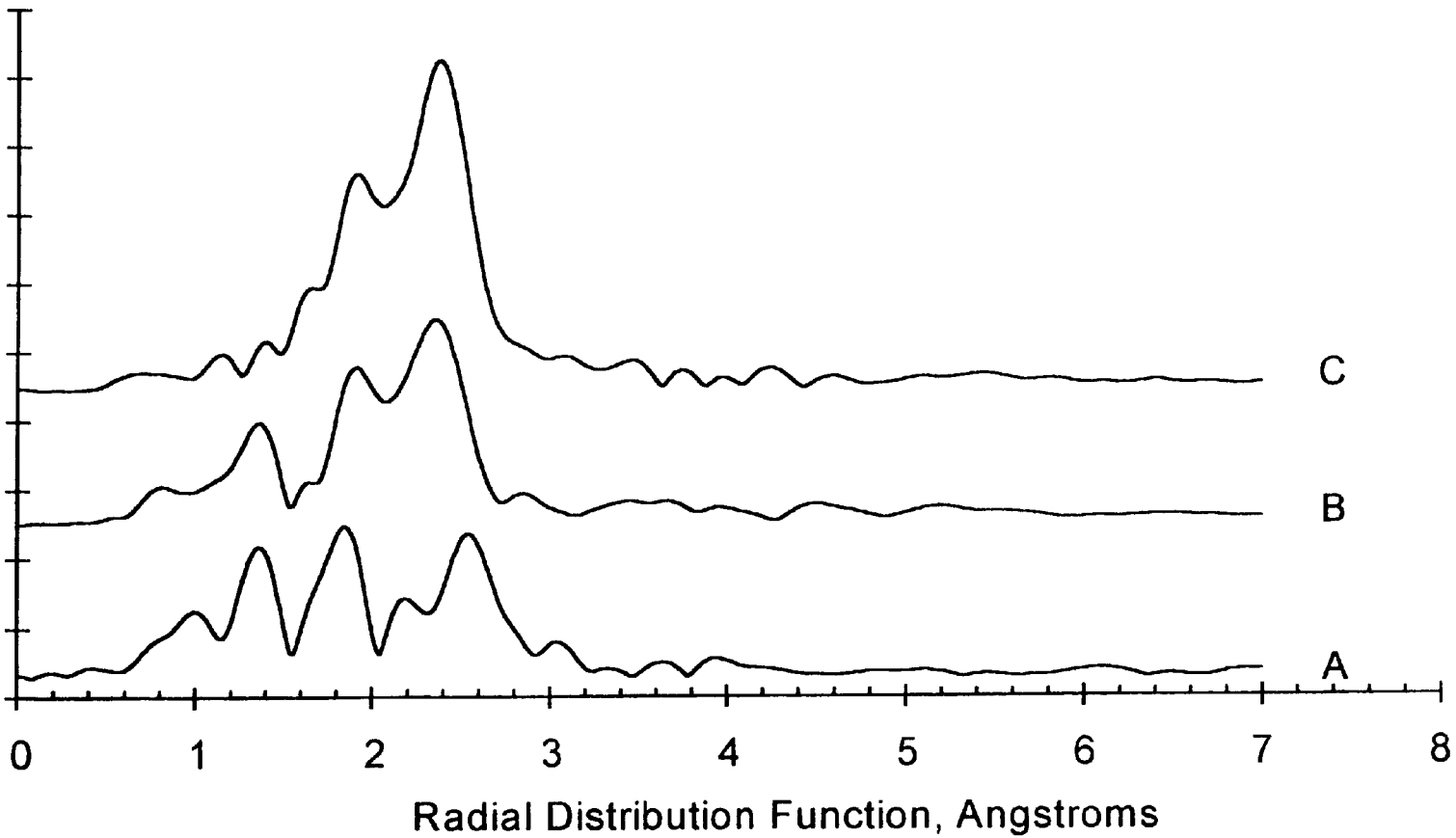
FIG. 1 is a plot of the radial distribution function centered on the molybdenum atom (in Angstroms), derived from the molybdenum EXAFS spectra of: (A) molybdenum dithiocarbamate; (B) reaction product of molybdenum dithiocarbamate with dialkyldithiophosphoric acid at 150° C. for 16 hours and an air sparge of 55 cc/minute; and (C) $Mo_3S_7$ coco $(DTC)_4$.

This invention is a method for forming a lubricating composition comprising adding to a major amount of an oil of lubricating viscosity a minor amount of an additive obtained by the reaction of molybdenum dialkyl dithiocarbamate with dihydrocarbyl dithiophosphoric acid in air at a temperature ranging from above about 135° C. to about 200° C., preferably about 150° C.

In another embodiment, the invention is a method for enhancing the friction reducing properties and extending the friction retention benefits of a lubricating oil composition having a major amount of a lubricating oil and a minor amount of an additive obtained by the reaction of molybdenum dialkyl dithiocarbamate with dihydrocarbyl dithiophosphoric acid in air at a temperature ranging from above about 135° C. to about 200° C., preferably about 150° C.

The present invention may comprise, consist or consist essentially of the elements disclosed therein and may be practiced in the absence of an element not disclosed and includes the products produced by the processes disclosed herein.

DESCRIPTION OF THE INVENTION

The present invention is directed to a multifunctional lube additive formed as the reaction product of a dihydrocarbyl dithiophosphoric acid (as opposed to the metal containing salt) and molybdenum dithiocarbamate in air at a temperature above 135° C. to about 200° C., preferably about 150° C. The invention also relates to a lubricant formulation additive that imparts improved friction retention characteristics to the lubricant in which it is employed compared with the friction retention properties of organo molybdenum dithiocarbamates.

The product is prepared by reacting the dihydrocarbyl dithiophosphoric acid and molybdenum dithiocarbamate at a temperature above about 135° C. to about 200° C., preferably about 150° C. at times sufficient for reaction to occur, preferably for about 8 to 16 hours, with an air sparge sufficient to saturate the mixture with air. Molybdenum compounds typically show enhanced friction retention benefits at increased temperatures.

Advantageously, the reaction product is produced in the absence of any precipitate formation as would be the case when metal dihydrocarbyl dithiophosphates are used.

Any dihydrocarbyl dithiophosphoric acid (non-metal containing) in which the solubilizing ligands are $C_3$–$C_{16}$ hydrocarbyl ligands, and combinations thereof are usable as starting materials in production of the composition of the present invention. While alkyl ligands are preferred, the invention can also be practiced with ligands having organo groups selected from aryl, substituted aryl, and ether groups. Preferably, the solubilizing ligands are $C_3$–$C_{12}$ primary, secondary, mixed primary-secondary alkyl ligands, and combinations thereof.

The molybdenum dithiocarbamates (MoDTC) usable as starting materials in production of the composition of the present invention are represented by the structural formula shown below:

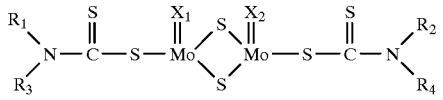

where $R_1$–$R_4$ are independently selected $C_3$–$C_{16}$ hydrocarbyl ligands preferably primary, secondary, mixed primary-secondary alkyl ligands, and mixtures thereof. $X_1$ and $X_2$ are each, either O or S. While alkyl ligands are preferred, the invention can also be practiced with aryl and alkyl aryl ligands.

In practicing the present invention, the list of usable starting materials is quite broad, being generally defined as dihydrocarbyl dithiophosphoric acids and molybdenum dithiocarbamates, combined in any suitable ratio.

The starting materials are combined and reacted at temperatures of above about 135° C., preferably about 150° C., at times sufficient for reaction to occur, preferably about 8–16 hours at temperatures of about 150° C. with air sparge sufficient to saturate the reaction mixture with air. Advantageously this results in a soluble product without undesirable insoluble metal containing materials. The reaction product will be used in the formulated oil in an amount sufficient to attain the desired molybdenum concentration in the formulated oil and to impart the desired friction characteristics.

Alternatively, the resulting reaction product may be added to a suitable oleaginous carrier in order to form a concentrate for blending with lubricating oils. The amount of reaction product ranges from about 1 to about 100% based on the weight of the carrier and reaction product. Suitable oleaginous carriers include base stock, animal oils, vegetable oils, mineral oil, synthetic oils, and mixtures thereof.

The amount of reaction product, per se, measured as a function of molybdenum wt % active ingredient, in the final formulated oil will range from 0.004 wt % to 0.4 wt %, and preferably from 0.005 wt % to 0.2 wt %.

The lubricating composition according to the invention requires a major amount of lubricating oil basestock. In general, the lubricating oil basestock will have a kinematic viscosity ranging from about 2 to about 1,000 cSt at 40° C. The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude.

Natural lubricating oils include animal oils, vegetable oils (e.g., castor oils and lard oil), petroleum oils, mineral oils, and oils derived from coal or shale, and mixtures thereof.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic aids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, re-refined oils, or mixtures thereof, Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The lubricating oil formulation containing the reaction product is compatible with and may also contain one or more of the following classes of additives: viscosity index improvers, antioxidants, friction modifiers, anti-foamants, anti-wear agents, corrosion inhibitors, hydrolytic stabilizers, metal deactivator, detergents, dispersants, pour point depressants, extreme pressure additives, etc. These can be combined in proportions known in the art.

This invention may be further understood by reference to, but not limited by, the following examples which include preferred embodiments.

GENERAL

"Coco" is an alkyl chain or mixture of chains of varying even numbers of carbon atoms of from about typically $C_8$ to $C_{18}$. "DTC" means dialkyldithiocarbamate. "MoDTC" means molybdenum dithiocarbamate. "DDPA" means dialkyl dithiophosphoric acid.

EXAMPLE 1

One method of preparation of the compound is by the reaction of commercial molybdenum dithiocarbamate (MoDTC) with dihydrocarbyl dithiophosphoric acid in a batch reactor at 150° C. with an air purge of 55 cc/min for 16 hours. In our example, the MoDTC material was Sakura Lube 155 available from Asahi Denka Kogyo and the dihydrocarbyl dithiophosphoric acid (DDPA) was 2-ethylhexyl dithiophosphoric acid. Sakura Lube 155 contains 4.5% w/w Mo. The starting reactants were used at 20 grams of Sakura Lube 155 and 9.162 grams of 2-ethylhexyl dithiophosphoric acid. The reaction product was then dialyzed through a latex membrane and the retained phase was used.

The reaction product was identified by its spectroscopic signature. FIG. 1 is a radial distribution function (RDF) centered on the molybdenum atom, derived from the molybdenum EXAFS spectra. Comparing the molybdenum RDF of the molybdenum dithiocarbamate starting material (A) with the spectrum (B) of the reaction product of molybdenum dithiocarbamate with dialkyl dithiophosphoric acid at 150° C. for 16 hours in air, it is clear that the RDF is changed in (B), indicating a change in the chemical coordination of the molybdenum atom. Spectrum C is the RDF of $Mo_3S_7$ coco$(DTC)_4$ and is also plotted for comparison.

6.10 grams of the reaction product of MoDTC with DDPA were added to 350 grams of a formulated engine oil without friction modifier. The concentration of Mo as measured by inductively coupled plasma (ICP) was 432 wppm in the formulated engine oil. This oil was in turn subjected to a nitration test. In this test, 250 grams of oil are heated at 150° C. and exposed to 1% $NO_2$ in air gas flow through sparger tubes. The gas flow rate is 60 mL/min. Similar tests have been disclosed in the literature by K. Arai et al, SAE 952533 (1995) and M. D. Johnson et al., SAE 952532, (1995). This bench test is used to simulate the degradation of engine oils, and MoDTC in particular. Degradation of MoDTC is known to happen in engine and vehicle tests resulting in loss of frictional performance.

Oil samples of approximately 12 grams were removed at regular time intervals from the nitration rig and subjected to tribological testing in the Cameron-Plint. This is a ball-on-plate tribometer measuring friction coefficients ("fc") under 5 kg load, 21 Hz, and 5 mm stroke. The friction coefficient results are summarized in Table 1.

A similar sample was prepared by dissolving 3.5 grams of the commercial molybdenum dithiocarbamate (MoDTC) Sakura Lube 155 in 350 grams of the same starting engine oil. The concentration of Mo as measured by ICP was 417 wppm in the formulated engine oil. This oil was subjected to the same nitration and friction testing as the oil with the reaction product of MoDTC with dialkyldithio phosphoric acid described above. The friction coefficient results are summarized in Table 2.

Comparing the data in Tables 1 and 2, the oil containing the reaction product of MoDTC with dialkyldithiophosphoric acid retained low friction coefficients at high temperatures for longer period of time of exposure in the nitration rig compared with the oil which contained the commercial MoDTC material. Specifically, the friction coefficient of the reaction product of MoDTC and DDPA at 135° C. increased after 16 hours of aging in the $NO_x$ rig compared with 8 hours of aging of the oil containing MoDTC alone.

TABLE 1

Friction coefficients of a fully formulated engine oil containing the reaction product of MoDTC and DDPA in Example 1. The oil was aged in a $NO_x$ bench test at the times indicated and friction coefficients were measured in the Cameron-Plint ball-on-plate tribometer.

| Time of $NO_x$ Aging (hrs) | fc @ 48° C. | fc @ 70° C. | fc @ 108° C. | fc @ 135° C. |
|---|---|---|---|---|
| 0 | 0.065 | 0.12 | 0.114 | 0.102 |
| 2 | 0.047 | 0.044 | 0.046 | 0.058 |
| 4 | 0.05 | 0.041 | 0.045 | 0.045 |
| 6 | 0.1 | 0.07 | 0.045 | 0.048 |
| 8 | 0.11 | 0.1 | 0.045 | 0.047 |
| 12 | 0.117 | 0.12 | 0.113 | 0.039 |
| 16 | 0.118 | 0.124 | 0.11 | 0.078 |

TABLE 2

Friction coefficients of a fully formulated engine oil containing MoDTC. The oil was aged in a $NO_x$ bench test at the times indicated and friction were measured in the Cameron-Plint ball-on-plate tribometer.

| Time of $NO_x$ Aging (hrs) | fc @ 48° C. | fc @ 70° C. | fc @ 108° C. | fc @ 135° C. |
|---|---|---|---|---|
| 0 | 0.055 | 0.044 | 0.086 | 0.064 |
| 2 | 0.047 | 0.045 | 0.04 | 0.04 |
| 4 | 0.055 | 0.036 | 0.036 | 0.036 |
| 6 | 0.112 | 0.115 | 0.116 | 0.045 |
| 8 | 0.108 | 0.1 | 0.118 | 0.115 |
| 12 | 0.118 | 0.122 | 0.124 | 0.123 |
| 16 | 0.119 | 0.124 | 0.124 | 0.12 |

EXAMPLE 2

In another method of preparation, 104.165 grams of MoDTC additive and 46.618 grams of 2-ethylhexyl dithiophosphoric acid were added in a batch reactor and the reaction took place at 150° C. with an air purge of 55 cc/min for 10 hours. The MoDTC material was Sakura Lube 155 available from Asahi Denka Kogyo and the dihydrocarbyl dithiophosphoric acid (DDPA) was 2-ethylhexyl dithiophosphoric acid. The reaction product was used without dialysis separation.

4.857 grams of the reaction product of MoDTC with DDPA were added to 295.314 grams of a fully formulated engine oil (without friction modifier), the same formulation used in Example 1. This oil was in turn subjected to the same nitration test described in Example 1. Oil samples of approximately 12 grams were removed at regular time intervals from the nitration rig and subjected to tribological testing in the Cameron-Plint, as described in Example 1. The friction coefficient results are summarized in Table 3. Friction retention was achieved up to 16 hours of aging in the $NO_x$rig.

A similar sample was prepared by dissolving the unreacted admixture of MoDTC and DDPA to the fully formulated oil mentioned earlier. 4.849 grams of this unreacted admixture were added to 295.146 grams of the engine oil. This oil was then subjected to the same nitration and friction testing described in Example 1. The friction coefficient results are summarized in Table 4.

Comparing the data in Tables 3 and 4, the oil containing the reaction product of MoDTC with dialkyldithio phosphoric acid retained low friction coefficients for longer period of time of exposure in the nitration rig compared with the oil which contained the unreacted admixture of MoDTC and DDPA.

TABLE 3

Friction coefficients of a fully formulated engine oil containing the reaction product of MoDTC and DDPA in Example 2. The oil was aged in a $NO_x$ bench test at the times indicated and friction coefficients were measured in the Cameron-Plint ball-on-plate tribometer.

| Time of $NO_x$ Aging (hrs) | fc @ 48° C. | fc @ 70° C. | fc @ 108° C. | fc @ 135° C. |
|---|---|---|---|---|
| 0 | 0.054 | 0.059 | 0.074 | 0.104 |
| 2 | 0.039 | 0.042 | 0.046 | 0.052 |
| 4 | 0.045 | 0.045 | 0.046 | 0.05 |
| 6 | 0.048 | 0.041 | 0.043 | 0.045 |
| 8 | 0.099 | 0.074 | 0.048 | 0.057 |
| 12 | 0.118 | 0.106 | 0.112 | 0.051 |
| 16 | 0.115 | 0.118 | 0.118 | 0.111 |
| 20 | 0.116 | 0.117 | 0.119 | 0.124 |
| 24 | 0.113 | 0.114 | 0.114 | 0.118 |

TABLE 4

Friction coefficients of a fully formulated engine oil containing the unreacted admixture of MoDTC and DDPA. The oil was aged in a $NO_x$ bench test at the times indicated and friction coefficients were measured in the Cameron-Plint ball-on-plate tribometer.

| Time of $NO_x$ Aging (hrs) | fc @ 48° C. | fc @ 70° C. | fc @ 108° C. | fc @ 135° C. |
|---|---|---|---|---|
| 0 | 0.041 | 0.055 | 0.064 | 0.056 |
| 2 | 0.044 | 0.039 | 0.043 | 0.05 |
| 4 | 0.042 | 0.039 | 0.036 | 0.034 |
| 6 | 0.096 | 0.074 | 0.037 | 0.036 |
| 8 | 0.111 | 0.109 | 0.093 | 0.031 |
| 12 | 0.118 | 0.114 | 0.124 | 0.114 |
| 16 | 0.116 | 0.117 | 0.117 | 0.127 |

EXAMPLE 3

In another method of preparation, 104.165 grams of MoDTC additive and 46.618 grams of 2-ethylhexyl dithiophosphoric acid were added in a batch reactor and the reaction took place at 150° C. with an air purge of 55 cc/min for 16 hours. The MoDTC material was Sakura Lube 155 available from Asahi Denka Kogyo and the dihydrocarbyl dithiophosphoric acid (DDPA) was 2-ethylhexyl dithiophosphoric acid. The reaction product was used without dialysis separation.

4.861 grams of the reaction product of MoDTC with DDPA were added to 295.189 grams of a fully formulated engine oil (without friction modifier), same formulation used in Example 1. This oil was in turn subjected to the same nitration test described in Example 1. Oil samples of approximately 12 grams were removed at regular time intervals from the nitration rig and subjected to tribological testing in the Cameron-Plint, as described in Example 1. The friction coefficient results are summarized in Table 5. Friction retention was achieved up to 16 hours of aging in the $NO_x$rig, similar with the results of the product after 10 hours of reaction (Example 2).

TABLE 5

Friction coefficients of a fully formulated engine oil containing the reaction product of MoDTC and DDPA in Example 2. The oil was aged in a $NO_x$ bench test at the times indicated and friction coefficients were measured in the Cameron-Plint ball-on-plate tribometer.

| Time of $NO_x$ Aging (hrs) | fc @ 48° C. | fc @ 70° C. | fc @ 108° C. | fc @ 135° C. |
|---|---|---|---|---|
| 0 | 0.065 | 0.07 | 0.083 | 0.083 |
| 2 | 0.067 | 0.07 | 0.077 | 0.076 |
| 4 | 0.04 | 0.041 | 0.045 | 0.049 |
| 6 | 0.05 | 0.043 | 0.047 | 0.047 |
| 8 | 0.064 | 0.059 | 0.047 | 0.045 |
| 12 | 0.116 | 0.108 | 0.11 | 0.043 |
| 16 | 0.114 | 0.117 | 0.122 | 0.12 |
| 20 | 0.112 | 0.117 | 0.12 | 0.123 |
| 24 | 0.101 | 0.116 | 0.124 | 0.113 |

What is claimed is:

1. A method for making a reaction product of molybdenum dithiocarbamate and dihydrocarbyl dithiophosphoric acid consisting essentially of:

the step of heating an admixture of a dihydrocarbyl dithiophosphoric acid and a molybdenum dithiocarbamate with an air sparse sufficient to saturate the admixture to a temperature ranging from above 135° C. to about 200° C. thereby producing the reaction product thereof.

2. A reaction product of molybdenum dithiocarbamate and dihydrocarbamyl dithiophosphoric acid wherein the reaction product is formed by a method consisting essentially of heating an admixture of dihydrocarbyldithiophosphoric acid and molybdenum dithiocarbamate with an air sparse sufficient to saturate the admixture at a temperature from above 135° C. to about 200° C.

3. A lubricating oil composition, comprising:

an admixture of a major amount of an oil of lubricating viscosity and an effective friction reducing and friction retention properties amount of a reaction product of molybdenum dithiocarbamate and dihydrocarbyl dithiophosphoric acid wherein the reaction product is formed by a method consisting essentially of heating an admixture of dihydrocarbyldithiophosphoric acid and molybdenum dithiocarbamate with an air sparge sufficient to saturate the admixture at a temperature from above 135° C. to about 200° C.

4. A method for enhancing the friction reducing and friction retention properties of a lubricating oil composition comprising:

adding to an oil of lubricating viscosity an effective friction reducing and friction retention properties amount of a reaction product of molybdenum dithiocarbamate and dihydrocarbyl dithiophosphoric acid wherein the reaction product is formed by a method consisting essentially of heating an admixture of dihydrocarbyidithiophosphoric acid and molybdenum dithiocarbamate with an air sparge sufficient to saturate the admixture at a temperature from above 135° C. to about 200° C.

5. An additive concentrate comprising an oleaginous carrier and at least about 1 wt % to about 100 wt % of a reaction product of molybdenum dithiocarbamate and dihydrocarbyl dithiophosphoric acid wherein the reaction product is formed by a method consisting essentially of heating an admixture of dihydrocarbyidithiophosphoric acid and molybdenum dithiocarbamate with an air sparge sufficient to saturate the admixture at a temperature from above 135° C. to about 200° C., based on the weight of the carrier and the compound.

6. The method of claim 1 wherein the dihydrocarbyl dithiophosphoric acid is a dialkyldithiophosphoric acid.

* * * * *